United States Patent [19]

Korte

[11] 4,212,395

[45] Jul. 15, 1980

[54] MULTI-ANGLED PERFORATED OPENING DEVICE

[75] Inventor: Ralph J. Korte, Darien, Ill.

[73] Assignee: Champion International Corporation, Stamford, Conn.

[21] Appl. No.: 969,224

[22] Filed: Jan. 22, 1979

[51] Int. Cl.[2] ..... B65D 17/20; B65D 17/24

[52] U.S. Cl. ..... 206/611; 206/628

[58] Field of Search ..... 206/609, 611, 608, 620, 206/628

[56] References Cited

U.S. PATENT DOCUMENTS

| | | | |
|---|---|---|---|
| 3,148,824 | 9/1964 | Foster et al. | 206/608 X |
| 3,255,948 | 6/1966 | Buttery | 206/608 X |
| 3,620,438 | 11/1971 | Wood et al. | 206/611 X |
| 3,829,006 | 8/1974 | Spiegel | 206/628 |
| 4,158,412 | 6/1979 | Wysocki | 206/628 X |

*Primary Examiner*—Stephen P. Garbe

*Attorney, Agent, or Firm*—Evelyn M. Sommer

[57] ABSTRACT

A carton of sheet fibrous material includes a removable access panel having a curvilinear peripheral outline defined by a plurality of spaced linear perforations. The outline comprises a plurality of pairs of associated arcuate segments, the perforations in each arcuate segment of an associated pair being the mirror image of the perforations in the other segment of the associated pair. All of the respective perforations of one of the arcuate segments are disposed at the same predetermined angle relative to the longitudinal axis of the access panel. Each of the pairs of arcuate segments defines a discrete panel section, at least one of the panel sections having a greater resistance to tearing than the other panel sections. The perforations of the panel section of higher resistance to tearing is disposed at a predetermined angle relative to the longitudinal axis of the access panel which is less than the angles to which the perforations of the other discrete panel sections are disposed relative to the longitudinal axis of the access panel. As a result, the access panel, while being readily removable from the carton, includes at least one support section defined by the panel section of higher resistance to tearing, thus protecting the carton from accidental collapse.

4 Claims, 4 Drawing Figures

MULTI-ANGLED PERFORATED OPENING DEVICE

BACKGROUND OF THE INVENTION

The subject invention relates to paperboard cartons, and specifically, to paperboard cartons having tear out opening members. Typically, the cartons contemplated are used as tissue boxes, and include a panel member which may be torn from the box in order to obtain access to the contents thereof. Generally, the access panel is outlined by perforations that maintain the panel intact in the carton until it is desired to attain access to the contents thereof. It has been found, however, that cartons of this type exhibit several shortcomings. For example, the cartons are generally made of paperboard material composed of laminated plies or layers that tend to separate or delaminate and present a ragged and unsightly appearance when the panel is removed. As a result, in use, the tissues have a tendency to become snarled along the ragged edges of the perforations. In addition, it has been difficult to provide an access panel which is both easy and convenient to remove, yet strong enough to prevent accidental collapse during handling and/or storage.

Accordingly, it is an object of the subject invention to provide a carton having a tear out access member or flap which is designed so as to permit the access member to be removed without there being left behind unsightly delaminations or ragged edges.

It is another object of the subject invention to provide a carton having the above described characteristics, and which has an access panel which is easy and convenient to remove, yet strong enough so as to minimize the risk of accidental collapse during handling and/or storage.

SUMMARY OF THE INVENTION

In accordance with the above recited objectives, the subject invention provides a carton of sheet fibrous material having a new and improved removable access panel. The access panel has a curvilinear peripheral outline, typically oval or round, which is defined by a plurality of spaced linear perforations, each perforation penetrating the entire thickness of the paperboard. In accordance with the subject invention the outline comprises a plurality of associated pairs of arcuate segments. All the perforations of a segment are disposed at substantially the same predetermined angle with respect to the longitudinal axis of the outline. However, the perforations of one segment are disposed at a different angle with respect to the longitudinal axis of the outline than the perforations of at least one of the segments immediately adjacent thereto. In addition, the perforations of each segment of an associated pair of segments is disposed at an angle relative to the longitudinal axis of the outline which is the mirror image of the angle of the perforations in the other segment of the associated pair. As a result, the access panel is provided with a plurality of discrete major and minor portions of varying resistance to tearing such that depending on the number of perforations and the particular angle at which the perforations of each segment are disposed relative to the longitudinal axis of the outline, an optimum condition is effected which provides ease of tearing yet strength against accidental collapse during handling and/or storage. In the preferred embodiment of the subject invention, the arcuate segments define alternating panel tear sections, i.e. sections having relatively little resistance to tearing, and panel support sections, i.e. sections having a relatively high resistance to tearing.

DESCRIPTION OF THE PREFERRED EMBODIMENTS

Figure 1:
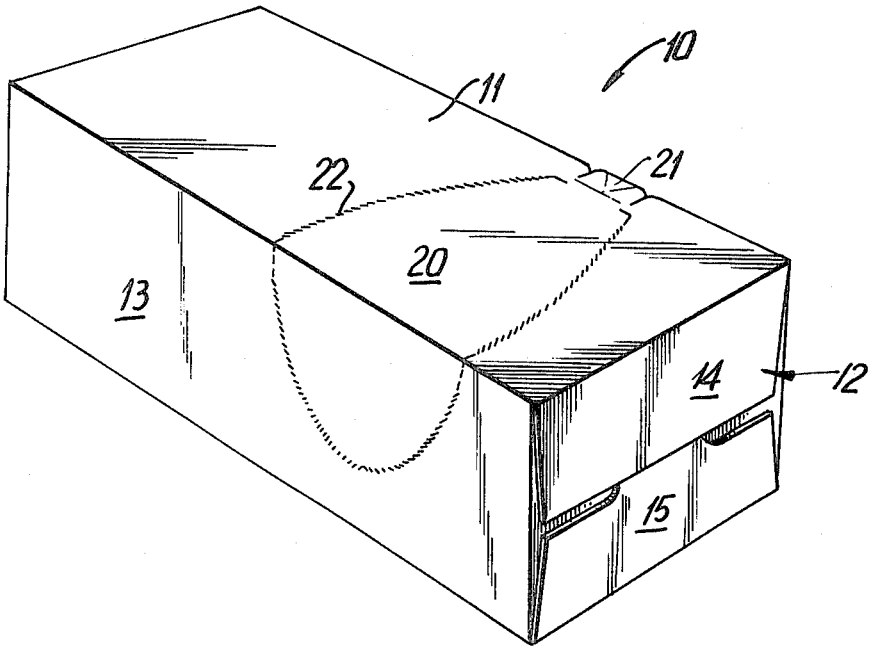
FIG. 1 is a perspective view of the carton of the subject invention.

Referring to FIG. 1, a typical carton employing the subject invention is designated generally by reference numeral 10 and comprises a tubular paperboard container for facial tissues and the like. As illustrated, container 10 includes a top wall 11, an end wall 12 having closure flaps 14 and 15, and a side wall 13. Although not shown, it will be appreciated that the subject carton 10 also includes another sidewall, end wall and bottom wall.

Further referring to FIG. 1, the access panel of the subject invention is designated generally by reference numeral 20. As illustrated, panel 20 has a generally oval periphery 22 which traverses walls 11 and 13. It will be appreciated, however, that access panel 20 may be other than oval in configuration, and in addition, it may be solely contained on one panel, such as for example, panel 11. Panel 20 includes a tab member 21 which may be grasped for facilitating the removal of panel 20 from the container. It will be noted that panel 20 also includes initial cuts 24 adjacent tab 21 to facilitate the initial tearing of the panel and also intermediate cuts 25 which link the portions of the panel 20 on wall 13 with those on wall 11, thus facilitating the tearing of the panel at said corner juncture.

Figure 3:
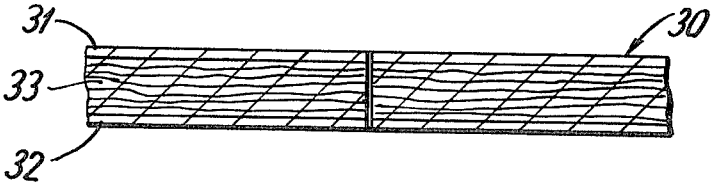
FIG. 3 is a cross sectional view of the access panel of the subject invention taken along line 3—3 of FIG. 2.

As illustrated in FIG. 3, the carton 10, and specifically the access panel 20 of the subject invention is formed of a paperboard substrate 30 having an upper surface 31, and undersurface 32, and a core 33 comprising several plies of very thin newsback board. Generally upper surface 31 is the printed portion of the carton. In addition, it is preferable that upper surface 31 have a protective coating, such as for example, a polyethylene coating. Undersurface 32 is generally merely the uncoated paperboard stock. The grain of the particles forming the substrate are generally aligned with the longitudinal axis X (see FIG. 2) of access member outline 22, and thus perpendicular to the edge interconnecting side wall 13 with top wall 11.

Figure 2:
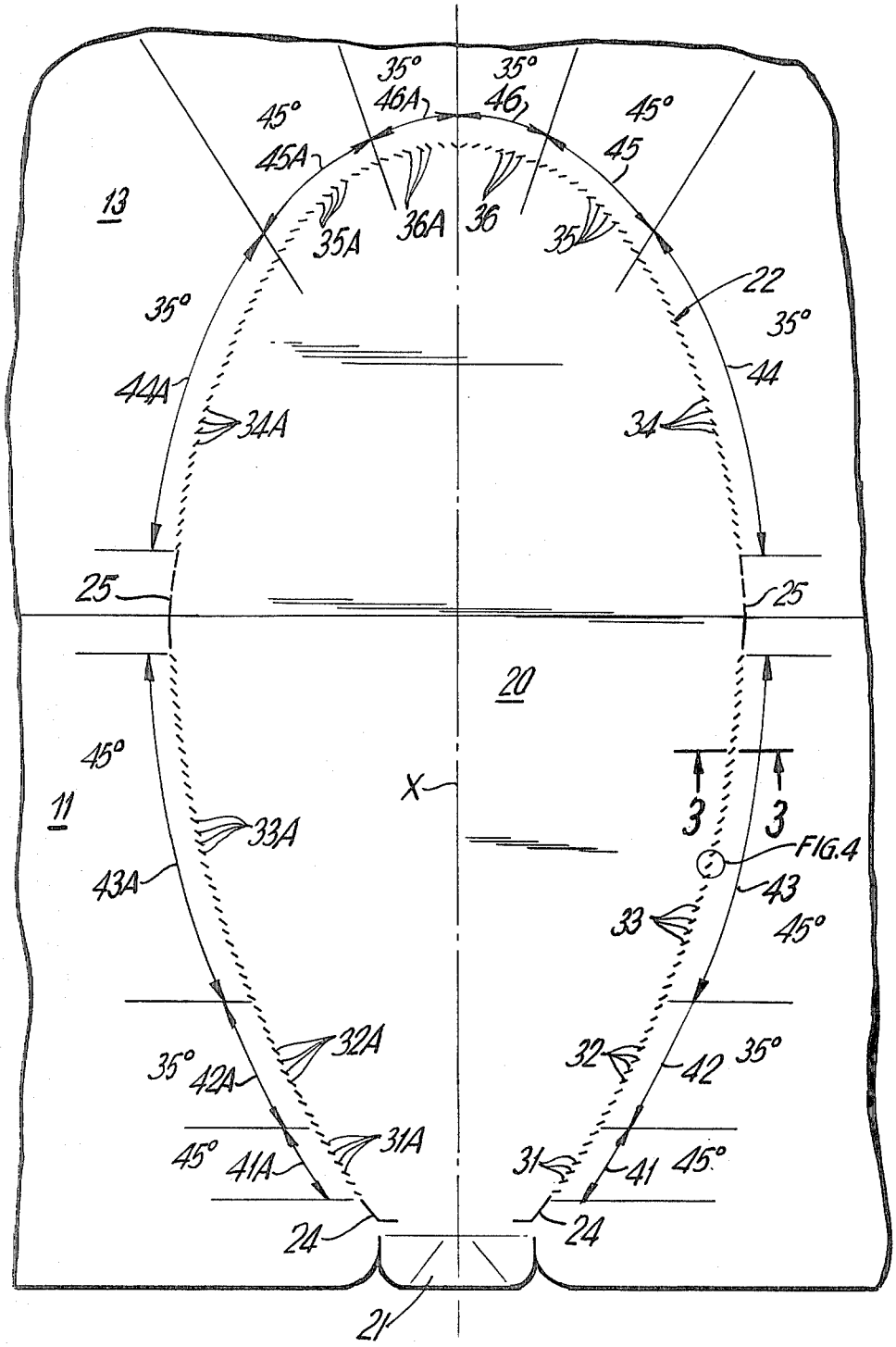
FIG. 2 is a plan view of the access panel of the carton of the subject invention.

Referring now to FIG. 2, it will be noted that access member outline 22 is defined by a plurality of spaced linear perforations 31–36 and 31A–36A, said perforations being divided into a plurality of associated pairs of arcuate segments, namely, 41 and 41A, 42 and 42A, 43 and 43A, 44 and 44A, 45 and 45A, and 46 and 46A. In accordance with the subject invention, all the perforations in a segment are disposed at a predetermined angle relative to the longitudinal axis X of outline 22. Thus, panel 20 is provided with a plurality of discrete sections of varying resistance to tearing. More particularly, a first pair of associated arcuate segments 41 and 41A is disposed adjacent pull tab 21 and initial cuts 24. As indicated above, tab 21 and cuts 24 are provided to facilitate the initial tearing and removing of panel 20 from the carton. In order to provide the access panel with proper support with the carton, the subject invention provides that segments 41 and 41A provide a first minor support section of relatively high or increased resistance to tearing. To this end, perforations 31 are disposed at a predetermined angle relative to the grain of the substrate 30 designed to resist tearing. Typically, the angle may be on the order of 45° relative to axis X. Similarly, perforations 31A of segment 41A are disposed at the same angle relative to axis X, it being understood, however, that the angle of perforations 31A is the mirror image of the angle of perforations 31. Thus, if the pertinent angles are measured relative to the horizontal, the angle of perforations 31A is the supplement of the angle of perforations 31. This relationship is the same for all of the pairs of segments to be described below, i.e., the angle of orientation relative to the horizontal of the perforations in one segment of an associated pair of segments is the supplement of the angle of orientation of the perforations in the other segment of said associated pair of segments. Thus, the panel 20 is provided with a first minor support section which protects the panel against accidental collapse during handling and/or storing.

Further referring to FIG. 2, panel 20 includes a second associated pair of arcuate segments, namely, 42 and 42A. In accordance with the subject invention, said segments are designed so as to provide panel 20 with a minor tear section of lower or diminished resistance to tearing than the section defined by segments 41 and 41A. To this end, perforations 32 and 32A are disposed at a predetermined angle relative to axis X, typically on the order of 35°. It will be noted that segments 42 and 42A define a panel section having a lower resistance to tearing than the section defined by segments 41 and 41A.

Figure 4:
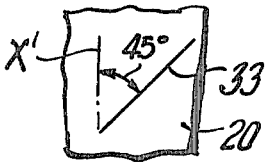
FIG. 4 is an enlarged view of one of the perforations of the access panel of the subject invention.

Referring still to FIG. 2, the subject access panel 20 includes a third associated pair of arcuate segments, namely, segments 43 and 43A. In accordance with the subject invention, segments 43 and 43A define a first major panel support section of relatively high or tougher resistance to tearing. Thus, perforations 33 and 33A are disposed at a predetermined angle relative to axis X to provide the desired increased resistance to tearing, the angle being typically on the order of 45°. It will be noted that in FIG. 4 there is illustrated an enlarged view of a perforation 33. As shown in FIG. 4, perforation 33 is disposed 45° relative to vertical axis X', said axis X' being parallel to longitudinal axis X of the carton panel, and thus parallel to the grain of the substrate 30 forming the carton walls.

Turning now again to FIG. 2, the subject access panel 20 includes a pair of cuts 25 which link the portion of panel 20 disposed on carton wall 11 with the portion of panel 20 disposed on carton wall 13. Cuts 25 penetrate the entire thickness of panel 20— and are included such that at the corner of carton 10 which forms the juncture of walls 11 and 13, there is minimal resistance to tearing.

Further referring to FIG. 2, the subject access panel 20 includes a fourth pair of associated arcuate segments 44 and 44A, said segments being defined by perforations 34 and 34A, respectively. In accordance with the subject invention, it is desired that segments 44 and 44A provide panel 20 with a first major tear section having a relatively low resistance to tearing so as to facilitate removal of the panel. In accordance with this objective, perforations 34 and 34A are disposed at a predetermined angle relative to longitudinal axis X to provide a relatively low resistance to tearing, said angle typically being on the order of 35°.

The subject access panel 20 further includes a fifth pair of associated arcuate segments 45 and 45A, said segments being defined by perforations 35 and 35A, respectively. In accordance with the subject invention, segments 45 and 45A provide panel 20 with a second minor support section having relatively high resistance to tearing. Thus, perforations 35 and 35A are disposed at a predetermined angle relative to longitudinal axis X so as to provide the desired resistance to tearing, said angle being typically on the order of 45°, thereby providing additional structural support to the panel to achieve adequate protection against accidental collapse during handling and/or storage.

The subject access panel 20 includes a sixth and final pair of associated arcuate segments 46 and 46A, said segments being defined by perforations 36 and 36A. In accordance with the subject invention, segments 46 and 46A provide panel 20 with an end portion and a second minor tear section which is designed to have a relatively low resistance to tearing. Thus, perforations 36 and 36A are disposed at a predetermined angle relative to longitudinal axis X so as to provide the desired low or diminished tear resistance, the angle typically being on the order of 35°.

In summary, the subject invention provides a carton having a new and improved removable access panel. In accordance with the subject invention, the access panel includes a plurality of pairs of associated arcuate major and minor segments having spaced perforations which define discrete panel sections of varying resistance to tearing. In the preferred embodiment of the subject invention, the pairs of arcuate segments are disposed so as to define panel sections which alternate between support sections, i.e., sections having a relatively high resistance to tearing and tear sections having relatively little resistance to tearing. To this end, the perforations of each segment are disposed at a predetermined angle relative to the longitudinal axis of the access panel so as to provide the desired resistance to tearing. As a result, the subject access panel, while being readily removable from its carton, is also protected against accidental collapse during handling and/or storage. More particularly, the subject panel provides an arrangement wherein, after tab 21 is lifted and initial tearing is effected along cuts 24, increased resistance to tearing is present along segments 41-41A. These minor support segments cooperate with major panel support segments 43-43A to provide sufficient structural rigidity to top wall 11. Disposed intermediate support segments 41-41A and 43-43A are minor tear panel segments 42-42A to facilitate tearing of panel 20. With respect to the side wall 13, since less direct force is applied perpendicular thereto during handling and/or shipping of the carton 10, the tear panel 20 includes major and minor tear segments 44-44A and 46-46A on opposite sides of intermediate support segments 45-45A. Hence removal of tear panel 20, and more particularly, the portion thereof formed in the side wall 13 is greatly facilitated, without compromising the strength of the carton.

While there have been described herein what are at present considered preferred embodiments of the invention, it will be obvious to those skilled in the art that many modifications and changes may be made therein without departing from the essence of the invention.

For example, as illustrated in FIG. 2, segments 41 and 41A each include seven perforations; segments 42 and 42A each include twelve perforations; segments 43 and 43A each include thirty-one perforations; segments 44 and 44A each include twenty-seven perforations; segments 45 and 45A each include twelve perforations; and segments 46 and 46A each include seven perforations. However, in accordance with the subject invention, the actual number of perforations in each arcuate segment may be varied. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. A carton of sheet fibrous material including a removable access panel having a curvilinear peripheral outline defined by a plurality of spaced linear perforations, said outline comprising a plurality of pairs of associated arcuate segments, the perforations in each arcuate segment of an associated pair of segments being the mirror image of the perforations in the other segment of said associated pair of segments, all of the respective perforations of one of the arcuate segments being disposed at the same predetermined angle relative to the longitudinal axis of said access panel, each of said pairs of arcuate segments defining a discrete panel section, at least one of said panel sections having a greater resistance to tearing than the other panel sections, the perforations of the panel section of higher resistance to tearing being disposed at a predetermined angle relative to the longitudinal axis of the access panel which is greater than the angle to which the perforations of the other discrete panel sections are disposed relative to the longitudinal axis of the access panel, said access panel being generally oval in configuration and including at one end thereof a pull tab; a first pair of spaced apart opposed cuts adjacent said pull tab; a first minor support section disposed adjacent said first pair of cuts, each of the arcuate segments defining said first minor support section having seven perforations; a first minor tear section disposed adjacent said first minor support section, each of the arcuate segments defining said first minor tear section having twelve perforations; a first major support section adjacent said first minor tear section, each of the arcuate segments defining said first major support section including thirty-one perforations; a second pair of spaced apart cut portions disposed adjacent said first major support section; a first major tear section disposed adjacent said second pair of cuts, each of the arcuate segments defining said first major tear section having twenty-seven perforations; a second minor support section disposed adjacent said first major tear section, each of the arcuate segments defining said second minor support section having twelve perforations; and a second minor tear section disposed adjacent said second minor support section, each of the arcuate segments defining said second minor tear section having seven perforations, such that the access panel, while being readily removable from the carton, includes at least one support section defined by said panel section of higher resistance to tearing, thus protecting the carton from accidental collapse.

2. A carton of sheet fibrous material as recited in claim 1 in which the perforations of each of said tear sections are disposed at an angle of approximately 35° relative to the longitudinal axis of said access panel; and each of the perforations of said support sections are disposed at an angle of approximately 45° relative to the longitudinal axis of said access panel.

3. A carton of sheet fibrous material including a removable access panel having a curvilinear peripheral outline defined by a plurality of spaced linear perforations and a pull tab at one end thereof, said outline comprising a plurality of pairs of associated arcuate segments, the perforations in each arcuate segment of an associated pair of segments being the mirror image of the perforations in the other segment of said associated pair of segments, said pairs of associated arcuate segments defining a first minor support section disposed adjacent said pull tab; a first minor tear section disposed adjacent said first minor support section; a first major support section adjacent said first minor tear section; a first major tear section disposed adjacent said first major support section; a second minor support section disposed adjacent said first major tear section; and a second minor tear section disposed adjacent said second minor support section, each of the perforations of said support sections being disposed at an angle of approximately 45° relative to the longitudional axis of the access panel, each of the perforations of said tear sections being disposed at an angle of approximately 35° relative to the longitudinal axis of the access panel, such that the access panel is provided with alternating support sections and tear sections, the tear sections enabling the access panel to be easily removed from the carton, the support sections protecting the access panel from accidental collapse.

4. A carton of sheet fibrous material as recited in claim 3 in which each of the segments defining said first minor support section includes seven perforations; each of the segments defining said first minor tear section includes twelve perforations; each of the segments defining said first major support section includes thirty-one perforations; each of the segments of said first major tear section includes twenty-seven perforations; each of the segments defining said second minor support section includes twelve perforations; and each of the segments defining said second minor tear section includes seven perforations.

* * * * *